US009134028B2

(12) United States Patent
Stastny et al.

(10) Patent No.: US 9,134,028 B2
(45) Date of Patent: Sep. 15, 2015

(54) COMBUSTOR FOR GAS TURBINE ENGINE

(75) Inventors: Honza Stastny, Georgetown (CA); Jeffrey Richard Verhiel, Toronto (CA); Parthasarathy Sampath, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 829 days.

(21) Appl. No.: 13/352,889

(22) Filed: Jan. 18, 2012

(65) Prior Publication Data

US 2013/0180257 A1 Jul. 18, 2013

(51) Int. Cl.
*F23R 3/04* (2006.01)

(52) U.S. Cl.
CPC ..... *F23R 3/04* (2013.01); *F23R 2900/03041* (2013.01)

(58) Field of Classification Search
CPC ... F01D 9/023; F01D 25/12; F05D 2260/201; F23R 2900/03044
USPC ..... 60/752, 39.37, 804
See application file for complete search history.

(56) References Cited

U.S. PATENT DOCUMENTS

| | | | | |
|---|---|---|---|---|
| 4,944,152 | A * | 7/1990 | Shekleton | 60/804 |
| 5,237,813 | A * | 8/1993 | Harris et al. | 60/804 |
| 5,279,127 | A * | 1/1994 | Napoli | 60/757 |
| 5,392,596 | A * | 2/1995 | Holsapple et al. | 60/753 |
| 6,286,317 | B1 * | 9/2001 | Burrus et al. | 60/752 |
| 6,393,828 | B1 * | 5/2002 | Zhao et al. | 60/752 |
| 6,810,672 | B2 | 11/2004 | Coutandin | |
| 7,093,439 | B2 | 8/2006 | Pacheco-Tougas et al. | |
| 7,308,794 | B2 | 12/2007 | Morenko et al. | |
| 7,624,577 | B2 | 12/2009 | Patel et al. | |
| 7,631,503 | B2 | 12/2009 | Stastny et al. | |
| 7,856,830 | B2 * | 12/2010 | Alkabie | 60/804 |
| 7,900,457 | B2 | 3/2011 | Patterson et al. | |
| 7,905,094 | B2 * | 3/2011 | Dudebout et al. | 60/752 |
| 2002/0116929 | A1 * | 8/2002 | Snyder | 60/752 |
| 2009/0308077 | A1 * | 12/2009 | Shelley et al. | 60/752 |
| 2011/0185735 | A1 | 8/2011 | Snyder | |
| 2011/0185736 | A1 | 8/2011 | McKinney | |
| 2011/0203287 | A1 | 8/2011 | Chila et al. | |

* cited by examiner

*Primary Examiner* — Ted Kim
(74) *Attorney, Agent, or Firm* — Norton Rose Fulbright Canada LLP

(57) ABSTRACT

A combustor with a liner where each of the walls has a respective circumferential row of dilution holes defined therethrough adjacent a junction between the primary zone and the dilution zone. In the primary zone, the inner surface of each of the walls is covered by at least one heat shield attached thereto and spaced apart therefrom to allow air circulation between the inner surface and the at least one heat shield, the walls each having a plurality of cooling holes defined therethrough having a smaller diameter than that of the dilution holes. In the dilution zone, the inner surface of each of the walls is free of heat shields, and the walls each have a plurality of effusion cooling holes defined therethrough and having a smaller diameter than that of the dilution holes.

12 Claims, 2 Drawing Sheets

COMBUSTOR FOR GAS TURBINE ENGINE

TECHNICAL FIELD

The application relates generally to a combustor of a gas turbine engine and, more particularly, to combustor cooling.

BACKGROUND OF THE ART

Some direct flow gas turbine engine combustors maintain very high temperatures in the primary zone to reduce emissions. However, increased temperatures of the combustion chamber typically require the chamber walls to be protected by heat shields throughout the length of the chamber, which may increase the weight, manufacturing time and/or cost of the engine.

SUMMARY

In one aspect, there is provided a combustor for a gas turbine engine, the combustor comprising: a liner having first and second concentric annular walls with interconnected upstream ends; an annular combustion chamber defined between inner surfaces of the walls, the combustion chamber having a primary zone adjacent the interconnected upstream ends and a dilution zone downstream of the primary zone; with each of the walls having a respective circumferential row of dilution holes defined therethrough adjacent a junction between the primary zone and the dilution zone; in the primary zone, the inner surface of each of the walls being covered by at least one heat shield attached thereto and spaced apart therefrom to allow air circulation between the inner surface and the at least one heat shield, the walls each having a plurality of cooling holes defined therethrough having a smaller diameter than that of the dilution holes; and in the dilution zone, the inner surface of each of the walls being free of heat shields, and the walls each having a plurality of effusion cooling holes defined therethrough and having a smaller diameter than that of the dilution holes.

In another aspect, there is provided a method of cooling walls defining a combustion chamber of a gas turbine engine combustor, the method comprising: shielding portions of the walls located upstream of a dilution flow into the combustion chamber while leaving portions of the walls located downstream of the dilution flow unshielded; creating a cooling flow through the shielded portions of the walls; and creating an effusion cooling flow through the unshielded portions of the walls.

In a further aspect, there is provided a combustor liner for a gas turbine engine, the liner comprising: first and second annular walls having interconnected upstream ends and defining a combustion chamber between inner surfaces thereof, each of the walls having a circumferential row of dilution holes defined therethrough spaced apart from the interconnected upstream ends, and a section located downstream of the dilution holes having effusion cooling holes defined therethrough, with the effusion cooling holes being smaller than the dilution holes; and means for shielding from heat the inner surface of a section of each of the walls located upstream of the dilution holes while leaving the inner surface of the section located downstream of the dilution holes unshielded.

DESCRIPTION OF THE DRAWINGS

Reference is now made to the accompanying figures in which.

DETAILED DESCRIPTION

Figure 1:
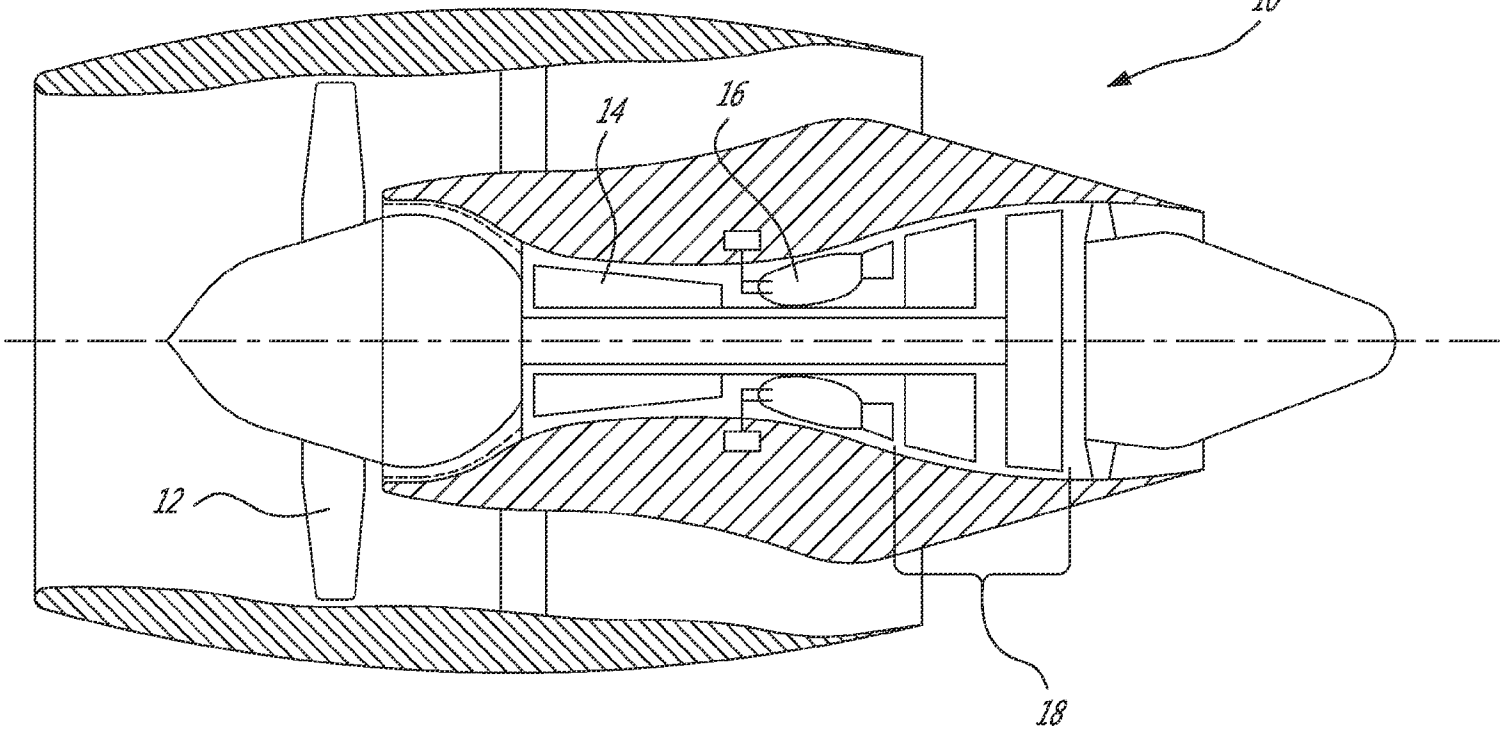
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
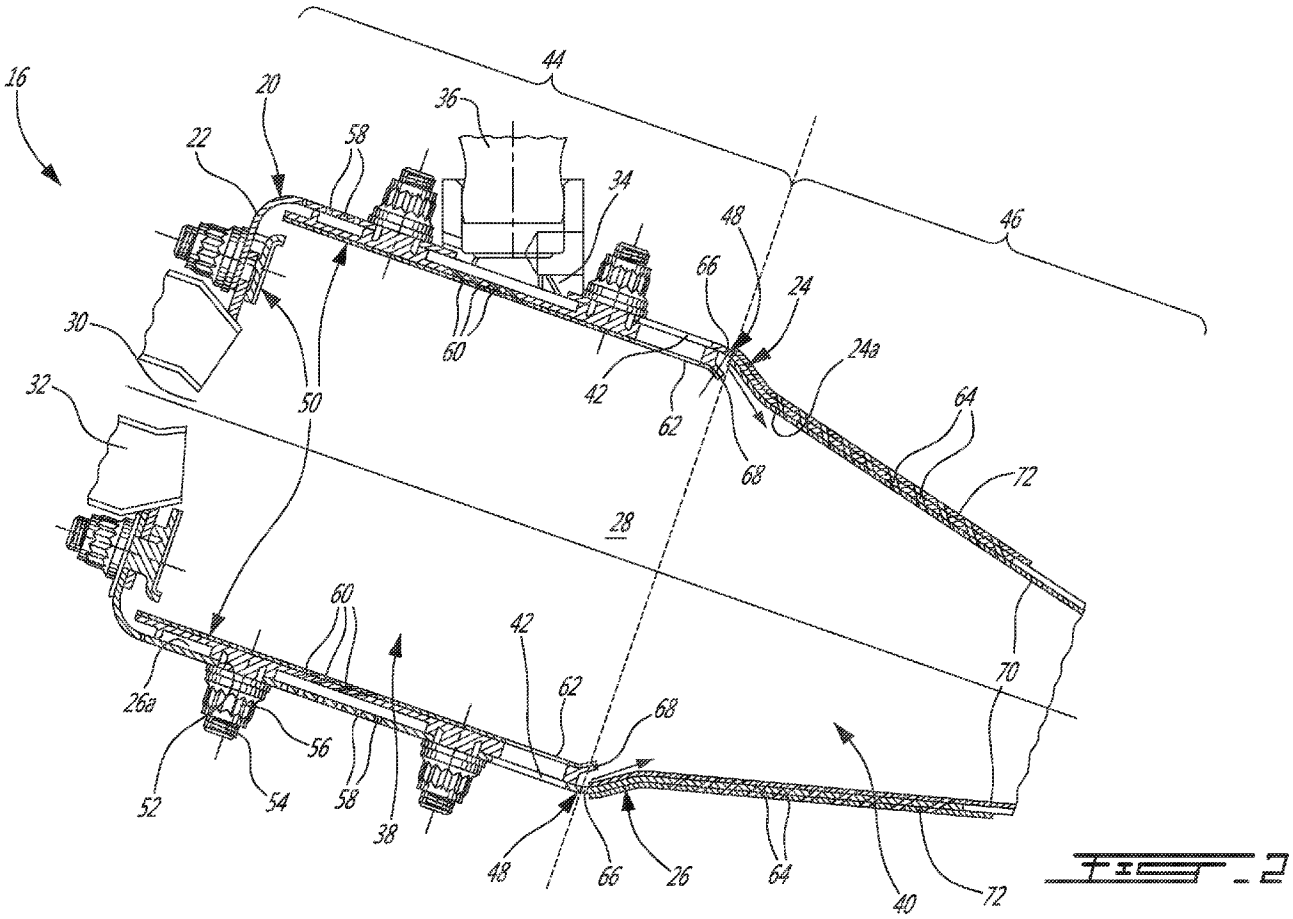
FIG. 2 is a schematic cross-sectional view of a combustor in accordance with a particular embodiment, which may be used in a gas turbine engine such as shown in FIG. 1.

Referring to FIG. 2, a section of the combustor 16 is generally illustrated. The combustor 16 includes a combustor liner 20 with two concentric annular walls 24, 26 having interconnected upstream ends defining a dome end 22. A combustion chamber 28 is defined between the inner surfaces 24*a*, 26*a* of the annular walls 24, 26. The dome end 22 includes a circumferential array of spaced apart fuel nozzle holes 30 defined therethrough (only one of which is shown), each of which receiving the tip of a respective fuel nozzle 32. Support boss areas 34 are defined in the outer wall 24, which receive support members 36 (only one of which is shown) supporting the combustor 16 within the engine 10.

The combustion chamber 28 includes a primary zone 38 extending from the dome end 22 and a dilution zone 40 defined downstream of the primary zone 38. In a particular embodiment, the temperature in the primary zone 38 may reach at least 1950° F. (1066° C.), for example 2100° F. (1149° C.). Such high temperatures in the primary zone 38 may help lower emissions of nitrogen oxides (NOx), unburned hydrocarbons (UHC) and carbon monoxide (CO) from the combustor. A circumferential row of dilution holes 42 is defined through each of the walls 24, 26 adjacent the junction between the two zones 38, 40. In a particular embodiment, the dilution holes 42 are sized to introduce up to 50% of the combustor air; in another embodiment, the dilution holes are sized to introduce more than 50% of the combustor air. As such, the dilution zone 40 is cooler than the primary zone 38.

In the embodiment shown, the liner 20 defines a first section 44 where the walls 24, 26 extend at a constant or approximately constant distance from one another, and a second section 46 downstream of the first section 44 where the walls 24, 26 are angled toward one another, each wall 24, 26 thus including a bend 48 between the first and second sections 44, 46. The respective circumferential row of dilution holes 42 of each wall 24, 26 is defined in the first section 44, in proximity of the bend 48. In this embodiment, the primary zone 38 may thus be defined as at least substantially corresponding to the first section 44 and the dilution zone 40 as at least substantially corresponding to the second section 46. Alternate configurations are of course possible.

In the primary zone 38, the inner surface 24*a*, 26*a* of each of the walls 24, 26 is covered by at least one heat shield 50. In a particular embodiment, the at least one heat shield 50 for each wall 24, 26 includes a circumferential array of adjacent heat shields, which may improve combustor durability by reducing or eliminating hoop stress. The portions of the walls 24, 26 defining the dome end 22 are also covered by at least one heat shield 50.

The heat shields 50 are connected to the respective wall 24, 26 such as to be spaced apart therefrom to allow fluid circulation between the inner surface 24*a*, 26*a* and the heat shields 50. Connection bores 52 are provided through each wall 24, 26 and connector posts 54 project from each heat shield 50, each post 54 being received in a respective one of the bores 52. Fasteners 56 (e.g., nuts, washers, rings, etc) are connected to the connector posts 54 so as to releasably attach the heat shields 50 to the combustor liner 20. Free ends of the connector posts 54 and the fasteners 56 are located outside of the combustion chamber 28. Alternately, any other adequate type of connection may be used to secure the heat shields 50 to the combustor liner 20, including blots, tabs, brackets, etc. In a particular embodiment the heat shields 50 are removable such as to be replaceable when damaged (e.g. by oxidation).

The walls 24, 26 each have a plurality of cooling holes 58 defined therethrough (only some of which being shown) under the heat shields 50, to direct cooling air thereon. In the embodiment shown, the heat shields 50 are effusion cooled and as such include a plurality of angled effusion cooling holes 60 defined therethrough (only some of which being shown), and the cooling holes 58 of the walls 24, 26 under the shields 50 are defined as impingement cooling holes. The impingement cooling holes 58 and effusion cooling holes 60 have a substantially smaller diameter than that of the dilution holes 42. For example, in a particular embodiment the impingement cooling holes 58 and the effusion cooling holes 60 have a diameter of approximately 0.020 in. (0.51 mm) while the dilution holes 42 have a diameter of approximately 0.5 in. (12.7 mm). In a particular embodiment, at least a major portion of each heat shield 50 has the effusion cooling holes 60 defined therethrough.

In a particular embodiment, the impingement cooling holes 58 and the effusion cooling holes 60 have a same diameter, but the impingement cooling holes 58 are provided in a smaller density than the effusion cooling holes 60. For example, in a particular embodiment the density of the impingement cooling holes 58 is approximately ½ that of the effusion cooling holes 60. The impingement cooling holes 58 are located along the walls 24, 26 in correspondence with the location of the effusion cooling holes 60 defined in the corresponding heat shields 50, such that the effusion cooling flow through each heat shield 50 is created from the impingement cooling flow through the respective wall 24, 26.

Alternately, the heat shields 50 may be pin-fin heat shields with a plurality of pin fins extending toward the respective inner surface 24*a*, 26*a* and without cooling holes defined therethrough, and the cooling holes 58 defined through the walls 24, 26 form jet apertures providing cooling air to the heat shields 50.

In the embodiment shown, the heat shields 50 also extend over the dilution holes 42 and as such have dilution holes 62 defined therethrough in alignment with the dilution holes 42 of the walls 24, 26.

In the dilution zone 40, the inner surface 24*a*, 26*a* of each of the walls 24, 26 is free of heat shields. The walls 24, 26 each have a plurality of angled effusion cooling holes 64 defined therethrough (only some of which being shown) also having a substantially smaller diameter than that of the dilution holes 42. In a particular embodiment, the wall effusion cooling holes 64 have a same diameter as the heat shield effusion cooling holes 60 but are provided in a smaller density. For example, in a particular embodiment the heat shield effusion cooling holes 60 are regularly spaced apart at approximately 0.1 in. (2.54 mm) from one another, and the wall effusion cooling holes 64 in the dilution zone 40 are regularly spaced apart at approximately 0.25 in. (6.35 mm) from one another. In a particular embodiment, a major part of the dilution zone section of each wall 24, 26 has the effusion cooling holes 64 defined therethrough.

In the embodiment shown, the effusion flow along the inner surface 24*a*, 26*a* in the dilution zone 40 is started by a circumferential array of starter holes 66 defined through each of the walls 24, 26 between the dilution holes 42 and the wall effusion cooling holes 64. In the embodiment shown, the heat shields 50 adjacent to the dilution zone 40 extend over the starter holes 66, and each have a downstream end 68 angled toward the opposed wall 24, 26, in correspondence with the adjacent bend 48, to form a louver directing the starter flow along the inner surface 24*a*, 26*a* of the wall in the dilution zone 40.

The louver end 68 of the heat shields 50 also helps direct the starter flow to impinge on the heat shield 50 at a location which may typically be difficult to cool, i.e. the area immediately downstream of the dilution holes 42, since the dilution flow may tend to interrupt the effusion cooling flow along the heat shields 50.

As shown, each of the walls 24, 26 in the dilution zone 40 may include an inner coating 70 defining the inner surface of the walls 24*a*, 26*a*, and/or an outer coating 72 provided on the layer of material extending from the primary zone 38; the resulting increased thickness of the walls 24, 26 in the dilution zone 40 increases the length of the effusion cooling holes 64 defined therethrough, which may help increase the efficiency of the effusion cooling. In a particular embodiment the inner coating includes a first layer of material similar to the wall material, and a second layer of heat resistant coating, for example an appropriate type of ceramic, provided thereon; the two layers may each have for example a thickness of about 0.010 in. (0.254 mm), for a total thickness of the inner coating 70 of about 0.020 in. (0.508 mm). In a particular embodiment, the outer coating 72, which may be made of a material similar to the wall material, is relatively thick, for example 0.040 in. (1.02 mm) thick. In a particular embodiment the outer coating 72 is thicker than the layer of material extending from the primary zone 38, which may be for example 0.035 in. (0.89 mm) thick. Such thick outer coating 72 may allow for a cost saving with respect to, for example, an alternate embodiment including two superposed skin layers welded together in the dilution zone 40 to provide sufficient wall thickness.

The elimination of heat shields 50 in the dilution zone 40 may allow for the manufacturing cost and total weight of the combustor 16 to be reduced, in comparison with a similar combustor in which the walls are protected by heat shields in both the primary zone 38 and the dilution zone 40.

The above description is meant to be exemplary only, and one skilled in the art will recognize that changes may be made to the embodiments described without departing from the scope of the invention disclosed. For example, the cooling scheme described above can be applied to combustors having different configurations than that shown. The combustor may be used in other types of engines, including turboprops and turboshafts. Still other modifications which fall within the scope of the present invention will be apparent to those skilled in the art, in light of a review of this disclosure, and such modifications are intended to fall within the appended claims.

The invention claimed is:

1. A combustor for a gas turbine engine, the combustor comprising:

a liner having first and second concentric annular walls with interconnected upstream ends;

an annular combustion chamber defined between inner surfaces of the walls, the combustion chamber having a primary zone adjacent the interconnected upstream ends and a dilution zone downstream of the primary zone; with each of the walls having a respective circumferential row of dilution holes defined therethrough adjacent a junction between the primary zone and the dilution zone;

in the primary zone, the inner surface of each of the walls being covered by at least one heat shield attached thereto and spaced apart therefrom to allow air circulation between the inner surface and the at least one heat shield, the walls each having a plurality of cooling holes defined therethrough having a smaller diameter than that of the dilution holes; and in the dilution zone, the inner surface of each of the walls being free of heat shields, and the walls each having a plurality of effusion cooling holes defined therethrough and having a smaller diameter than that of the dilution holes;

wherein the at least one heat shield of each of the walls extends over the dilution holes thereof and includes a dilution hole defined therethrough in alignment with each of the dilution holes of a respective one of the walls, and each of the walls includes cumferential row of starter holes defined therethrou downstream of the dilution holes and under a downstream end of each heat shield extending adjacent the dilution zone, and the downstream end of each heat shield extending adjacent the dilution zone is angled away from the inner surface of the primary zone to direct a flow from the starter holes along the inner surface of the dilution zone.

2. The combustor as defined in claim 1, wherein in the primary zone, the cooling holes are impingement cooling holes, and the at least one heat shield has a plurality of effusion cooling holes defined therethrough.

3. The combustor as defined in claim 2, wherein the effusion cooling holes defined through the at least one heat shield and the impingement cooling holes have a same diameter, a density of the impingement cooling holes being smaller than a density of the effusion cooling holes defined through the at least one heat shield.

4. The combustor as defined in claim 2, wherein the effusion cooling holes defined through the at least one heat shield and through the walls have a same diameter, a density of the effusion cooling holes defined through the walls being smaller than a density of the effusion cooling holes defined through the at least one heat shield.

5. The combustor as defined in claim 1, wherein for each of the walls, the at least one heat shield includes a circumferential row of adjacent heat shields.

6. The combustor as defined in claim 1, wherein the combustion chamber is a direct flow combustion chamber.

7. The combustor as defined in claim 1, wherein in the dilution zone, each of the walls includes an outer coating having a thickness greater than a thickness of the wall in the primary zone.

8. A combustor liner for a gas turbine engine, the liner comprising:

first and second annular walls having interconnected upstream ends and defining a combustion chamber between inner surfaces thereof, each of the walls having a circumferential row of dilution holes defined therethrough spaced apart from the interconnected upstream ends, and a section located downstream of the dilution holes having effusion cooling holes defined therethrough, with the effusion cooling holes being smaller than the dilution holes; and means for shielding from heat the inner surface of a section of each of the walls located upstream of the dilution holes while leaving the inner surface of the section located downstream of the dilution holes unshielded;

wherein each of the walls includes a circumferential row of starter holes defined therethrouqh downstream of the dilution holes, the means for shielding also directing a flow from the starter holes along the inner surface of the section of the walls located upstream of the dilution holes.

9. The liner as defined in claim 8, wherein the means for shielding include effusion cooled heat shields.

10. The liner as defined in claim 8, wherein the combustion chamber is a direct flow combustion chamber.

11. The liner as defined in claim 8, wherein the only dilution holes defined in each of the walls are the dilution holes of the respective circumferential row.

12. The liner as defined in claim 8, wherein the means for shielding resist a temperature of at least 1950° F.

* * * * *